US005816165A

United States Patent [19]

Huston

[11] Patent Number: 5,816,165

[45] Date of Patent: Oct. 6, 1998

[54] METHOD OF ENCODING ROLL LENGTH INDICIA ON PRINTER MEDIA

[75] Inventor: Craig S. Huston, Escondido, Calif.

[73] Assignee: Hewlett-Packard Company, Palo Alto, Calif.

[21] Appl. No.: 798,528

[22] Filed: Feb. 10, 1997

[51] Int. Cl.[6] ..... B65H 26/06; G08B 5/00

[52] U.S. Cl. ..... 101/490; 116/200; 116/201; 33/773; 33/37; 242/563.2; 242/912; 101/485

[58] Field of Search ..... 101/485, 490; 116/200, 201; 33/772, 773, 779, 36, 37, 38; 242/344, 563.2, 912

[56] References Cited

U.S. PATENT DOCUMENTS

| | | | |
|---|---|---|---|
| 2,077,242 | 4/1937 | La Pierre | 116/200 |
| 2,215,052 | 9/1940 | Price et al. | 164/84.5 |
| 2,780,352 | 2/1957 | Schroeder | 206/58 |
| 3,158,938 | 12/1964 | Philipps et al. | 33/733 |
| 3,327,941 | 6/1967 | Stauffer | 33/773 |
| 3,541,960 | 11/1970 | Dilsner et al. | 101/490 |
| 4,372,049 | 2/1983 | Hogue | 33/36 |
| 4,901,663 | 2/1990 | De Luca | 116/200 |
| 5,474,249 | 12/1995 | Koizumi et al. | 242/344 |

FOREIGN PATENT DOCUMENTS

| | | | |
|---|---|---|---|
| 62031655 | 2/1987 | Japan . | |
| 63-66058 (A) | 3/1988 | Japan | 242/563.2 |
| 63-154566 (A) | 6/1988 | Japan | 242/563.2 |
| 63154566 | 6/1988 | Japan . | |
| 63-233883 (A) | 9/1988 | Japan | 101/485 |
| 63295355 | 12/1988 | Japan . | |
| 02207244 | 8/1990 | Japan . | |
| 80181850 | 7/1996 | Japan . | |

*Primary Examiner*—Edgar S. Burr
*Assistant Examiner*—Amanda B. Sandusky

[57] ABSTRACT

Rolls of printer paper are marked with information which indicates the length of paper remaining on a roll by measuring the distance between indicia successively applied by two separate print drums which each apply indicia at substantially equally spaced first and second intervals, respectively. The length of paper remaining on the roll is determinable by measuring the spacing between indicia applied by each drum. Some of the applied indicia may also be bar-coded with roll length indicia which includes a second means of determining length of paper remaining on a print roll and other information such as paper type, total roll length and name of the manufacturer. The indicia can be applied at speeds of paper travel substantially higher than the fastest known dynamic printing techniques.

21 Claims, 1 Drawing Sheet

METHOD OF ENCODING ROLL LENGTH INDICIA ON PRINTER MEDIA

CROSS REFERENCE TO RELATED APPLICATIONS, IF ANY

None.

BACKGROUND OF THE INVENTION AND PRIOR ART

1. Field of the Invention

The present invention relates to computer driven printers which use rolls of print media and, more particularly, to methods of placing indicia on the media to indicate the total length of the roll and the length remaining on the roll. For convenience in explanation, instead of the term "print media", the term "paper" will be frequently used herein and is defined and intended to encompass all forms of print media which may be provided in roll form including paper, vellum, etc. As herein used, the term "face side" of a sheet of paper or other media on which printing is to take place means either one or both of the broad flat sides of the media and not the edge sides or top or bottom side edges of the media.

Many printers accept rolls of paper as the paper source. The user often needs to know the length of the paper left on the roll in the printer to ensure that the printer will not run out of paper in the middle of a print job. This information is provided to the user by the printer which needs to have a means of determining the length remaining on a roll. This problem is complicated, because fresh rolls of paper come in various lengths. In addition, to avoid wasting paper, a partially used roll may be removed from the printer and then put back into the printer at a later date. Hence, the printer must be given information in addition to the original length of a roll of paper.

Print length indicating marks may be applied to paper using dynamic printing techniques. Dynamic printing refers to printing in which the information to be printed changes with time. When the term "printing" is used herein it is intended that the term generally refers to application of marks of various human or machine readable characters including, but not limited to, visible and invisible printed marks such as bar-code whether directly printed on or otherwise applied to the paper or other media, such as by gummed labels or the like. The fastest known dynamic printing technique is ink jet printing which has a maximum speed of about 1200 ft./min. (365.76 meters/min.). During conversion of paper from a large commercial supply roll to individual rolls sized to be accepted by printers, paper moves at speeds of the order of 2500 ft./min. (762 meters/min.). If this speed were limited to a maximum of 1200 ft./min. (91.44 meters)/min. to accommodate the fastest known dynamic high speed printing, e.g., ink jet printing, the time (hence cost) of conversion would be more than doubled. So, printing the marks with known high speed ink jet printing technology is still impractical and too expensive.

The length of the roll left in the printer could instead be determined by a sensor on the printer to measure the continuously changing outside diameter of the roll in the printer. Knowing the inside and outside diameters of the roll of paper and the caliper of the paper, the printer could calculate the length of the roll left in the printer. In this scheme, the caliper of the paper would be known by the printer. The problem with this solution is the added cost of a sensor in the printer to determine the changing diameter of the roll.

2. Description of the Related Art

The current common technique for printing on media during manufacturing is to use a printing drum which rotates at the same speed as the media. The drum is etched with the mark or marks to be printed on the media. Since the marks are etched into the drum, there is no way of changing the marks with each revolution of the drum. In order to get dynamic information printed on a roll of paper, a drum with a circumference equal to the full length of the paper on the roll would be required. Since 150 ft. long rolls of paper are common, a drum with a diameter of 47 ft. would be required. A printing drum of this size is clearly not feasible.

It is accordingly desirable to provide a method of placing a printed code (possibly invisible to humans) on a roll or printer paper which indicates the length of paper remaining on the roll.

It is further desirable to provide marks replicated along the entire length of the roll of paper such that spacing between imprinted marks may be used to provide information indicative of the length of paper remaining on the roll at that location along the roll.

It is further desirable to provide a dynamic printing technique which prints marks which include paper length information on paper during formation of small rolls from a large supply of paper.

SUMMARY OF THE INVENTION

The present invention accordingly provides a method of applying length indicating indicia to print media comprising the steps of:

a) providing a continuous length of print media to be marked with length indicia;

b) applying first indicia to said media at substantially equally spaced first intervals along said length of print media; and c) applying second indicia to said media at substantially equally spaced second intervals along said length of print media, said second intervals being of length unequal to said first intervals; whereby the spacing between successive first and second indicia varies along the length of the marked print media.

DESCRIPTION OF THE PREFERRED EMBODIMENTS

Figure 1:
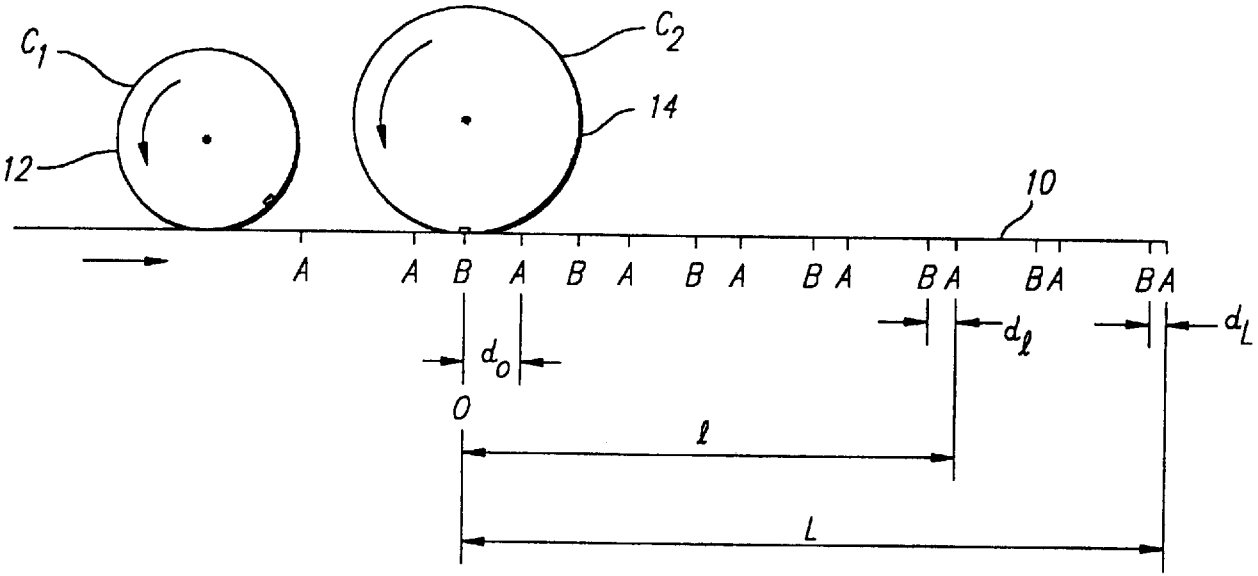
FIG. 1 is a schematic side elevation view of an apparatus applying machine readable length indication indicia to a printer paper to be formed into a roll.

FIG. 1 schematically shows a length of paper and one means comprising two separate print drums for dynamically applying roll length indicia to the paper. As is known to persons skilled in the art, such media may be applied by any one or more of a variety of printing techniques including gravure, letterpress, offset lithographic or flexographic printing technique.

A length of paper 10 from a commercially sized roll (not shown) travels to the right past first and second rotary printing drums 12, 14 which each apply length indicating marks A, B respectively, to the traveling length of paper. The first printing drum 12 preferably has a diameter slightly less than the diameter of the second drum 14 and applies marks A at equally spaced intervals along the length of paper 10. The second, larger, printing drum 14 applies indicia B at equally spaced lengths to the traveling sheet of paper.

Figure 2:
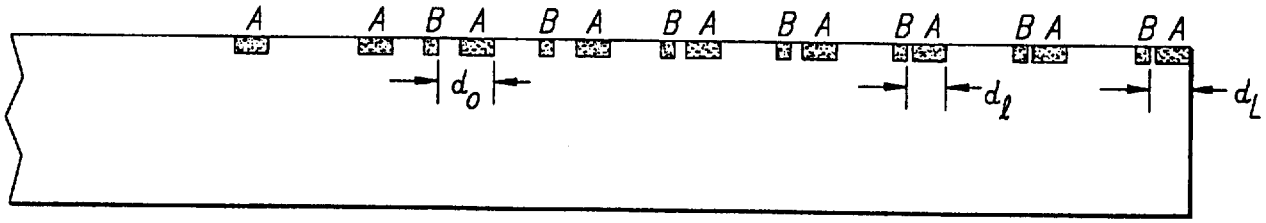
FIG. 2 is a plan view of a strip of paper to be formed into a roll which has been imprinted with paper length indicia.

For simplicity it is assumed that a single mark, A, B is applied during each revolution of each drum 12, 14 although it will be appreciated that multiple equally spaced indicia, A, B, can be applied by each drum if desired. Also, the distance between successive marks, A and B, is depicted in FIG. 2 as the distance between the leading edges of the marks. This distance can of course be measured in other ways such as the center to center distance between marks A and B. The distance $d_1$ varies as shown from $d_0$ at the point of application of the last-applied B mark (which may comprise the end of the roll of paper) to $d_L$ at the leading end of the strip of paper having a total length L. As shown in the drawing which is not to scale, $d_0$ is larger than $d_L$ when the second print drum 14 has a diameter larger than the first print drum 12. Observation of the distance $d_1$ therefore provides an indication of the remaining length 1 of the strip of paper at all times and constitutes a dynamic marking which has been applied to the paper by two separate print drums 12, 14, neither of which has means thereon for dynamic printing.

The marks A, B applied by the drums 12, 14 should never overlap since overlapping of the marks obscures the spacing therebetween preventing accurate measurement of $d_1$ and would therefore fail to yield the required remaining length information.

The first print drum 12 may apply a mark in the form of a bar-code which includes various information about the paper strip and resulting roll including media type, the manufacturer's name, etc.

The second print drum 14 may also apply a bar-code mark to the paper which itself encodes information indicative of the remaining length of paper. This can be accomplished by uniformly spacing indicia applying means around the circumference of the second drum 14. When this additional remaining paper length information is encoded into the bar-codes applied by the second print drum 14, a second means of determining remaining roll length is provided. Thus, the printer can detect remaining roll length by (1) determining the spacing $d_1$ between successively applied marks A, B and (2) reading the bar-codes applied by the second print drum 14. The information can therefore be combined to give accurate roll length information. Combining this information provides accurate roll length information when less accurate printing and detecting are used so that less stringent tolerances are required. Preferably, the two drums 12, 14 are rotated at precisely the same speed at which the paper travels to ensure accurate printing registration. The drums may be gear driven together to provide accurate synchronization as is well known. Additionally, it is entirely possible that more than two-print drums can be used to obtain even more accurate information.

By way of example and not limitation, and using only the distance $d_1$ between the first and second marks A, B to encode roll length information, Let:

L=Total, original length of the roll of media (integer value in feet)

l=Length of media left on the roll (integer value in feet)

$c_1$=Circumference of drum 1

$c_2$=Circumference of drum 2 d(1)=Distance between the marks A, B left by drum 1 and drum 2 at a distance 1 from the center of the roll of media (in inches).

p=number of marks on the media per foot.

Use:

$$d(1)=d(0)+1[d(L)-d(0)]/L$$

So:

$$1=L[d(1)-d(0)]/[d(L)-d(0)]$$

For a roll 150 feet long, allowing for a 2" bar-code by drum 1 and 0.5" bar-code by drum 2, with a 0.5" margin between bar-code 1 and 2, placing a bar-code every foot:

L=150 ft.

d(0)=11.0"

d(L)=3.0"

p=1 d(1)=11.0"+1[11.0"−3.0"]/150 ft.

or, d(1)=11.0"+1(8.0"/150 ft.)

and

1=[d(1)−11.0"](150 ft/3.0")

The resolution required can be computed as d(1+1)−d(1)=[11.0"+(1+1)(8.0"/150 ft.)]−11.0"+1(8.0"/150 ft.)] =8.0"/150 ft.=0.053"/ft.

Since p=1 the resolution required is resolution=0.053" This means that the combined error in printing and measuring the distance between bar-code 1 and bar-code 2 must be ≦0.053"/2=0.027" and $c_1$=12.000"

$c_2=c_1$+0.053"=12.053"

It is thus seen that new and economical methods of applying coded paper length information to paper to be formed into printer acceptable rolls have been disclosed.

Persons skilled in the art will readily appreciate that various modifications can be made from the preferred embodiment of the invention disclosed herein and that the scope of protection is intended to be defined only by the limitations of the appended claims.

I claim:

1. A method of applying length indicating indicia to print media comprising the steps of:

a) providing a continuous length of print media to be marked with length indicia;

b) applying first indicia to a face side of said media at substantially equally spaced first intervals along said length of print media; and c) applying second indicia to said face side of said media at substantially equally spaced second intervals along said length of print media, said second intervals being of length unequal to said first intervals; to provide machine readable predictably variable spacing between successive first and second indicia which varies along the length of the marked print media; and d) further comprising the step of forming a roll of print media from said length of marked media.

2. The method of claim 1, comprising the steps of moving said media along a print path, rotating a first print drum having indicia applying means on the circumference thereof to apply said first indicia to said length of moving media.

3. The method of claim 2, comprising the step of rotating a second print drum having indicia applying means on the circumference thereof to apply said second indicia to said length of moving media, said second drum having a diameter differing from the diameter of said first drum.

4. The method of claim 3, wherein said second print drum has a diameter less than said diameter of said first drum.

5. The method of claim 2, wherein said first drum has indicia applying means at equally spaced intervals around the circumference of said drum.

6. The method of claim 5, wherein said first drum has on a single indicia applying means thereon.

7. The method of claim 5, wherein said second drum has indicia applying means thereon at equally spaced intervals around the circumference of said drum.

8. The method of claim 7, wherein said second drum has only a single indicia applying means thereon.

9. The method of claim 1, comprising the step of applying machine readable indicia to said media.

10. The method of claim 9, wherein said indicia are invisible.

11. The method of claim 1, comprising the step of applying bar-code indicia to said media.

12. The method of claim 1, comprising the step of encoding said first indicia with information identifying characteristics of the print media.

13. The method of claim 1, comprising the step of encoding said second indicia with information identifying the length of the marked media.

14. The method of claim 13, comprising the step of encoding said second indicia with information which identifies the full length of the roll formed from said marked media.

15. The method of claim 14, comprising the step of further encoding said second indicia with information which further identifies the remaining length to end of the roll formed from said marked media.

16. The method of claim 14, comprising the further step of mechanically synchronizing rotation of the drums.

17. The method of claim 1, wherein said indicia are applied by a printing technique selected from the class consisting of gravure, letterpress, offset lithographic and flexographic printing.

18. A continuous roll of print media produced by the method of claim 1 having roll length indicating indicia on a face side of said media, said indicia comprising:

a) machine readable first indicia appearing at substantially equally spaced first intervals along said face side of said roll of print media; and c) machine readable second indicia appearing at substantially equally spaced second intervals along said roll of print media, said second intervals being of length unequal to said first intervals; whereby the spacing between successive first and second indicia predictably varies along the length of the marked print media.

19. A continuous roll of print media according to claim 18, wherein said indicia are bar codes.

20. A continuous roll of print media according to claim 19, wherein said first media provide information identifying characteristics of the print media.

21. A continuous roll of print media according to claim 18, wherein said second indicia provides information which identifies the remaining length to end of said roll.

* * * * *